US007267252B2

(12) United States Patent
Goodman

(10) Patent No.: US 7,267,252 B2
(45) Date of Patent: Sep. 11, 2007

(54) CORRUGATED CLOTHES HANGER STRUCTURE

(76) Inventor: Michael Goodman, 222 Home Ave., Trenton, NJ (US) 08611

( * ) Notice: Subject to any disclaimer, the term of this patent is extended or adjusted under 35 U.S.C. 154(b) by 316 days.

(21) Appl. No.: 10/865,974

(22) Filed: Jun. 14, 2004

(65) Prior Publication Data

US 2005/0274752 A1 Dec. 15, 2005

(51) Int. Cl.
*A41D 27/22* (2006.01)

(52) U.S. Cl. ..... 223/85

(58) Field of Classification Search ..... 223/85–98
See application file for complete search history.

(56) References Cited

U.S. PATENT DOCUMENTS

| | | | | |
|---|---|---|---|---|
| 4,542,838 A * | 9/1985 | Perez-Tubens et al. | ..... | 223/87 |
| 5,154,329 A * | 10/1992 | Dorfmueller | ..... | 223/37 |
| 5,797,640 A | 8/1998 | Schopfer | ..... | 294/152 |
| 6,021,934 A | 2/2000 | Ho | ..... | 223/98 |
| 6,041,985 A | 3/2000 | Balser | ..... | 223/91 |
| 6,050,462 A | 4/2000 | Petrou et al. | ..... | 223/96 |
| 6,206,255 B1 | 3/2001 | Turner | ..... | 223/98 |
| 6,328,186 B1 | 12/2001 | Wing | ..... | 223/94 |
| 6,481,603 B2 | 11/2002 | Gish | ..... | 223/96 |
| 6,508,388 B1 | 1/2003 | Louw | ..... | 223/96 |
| 2004/0031825 A1 * | 2/2004 | Roberts | ..... | 223/85 |

FOREIGN PATENT DOCUMENTS

| | | | |
|---|---|---|---|
| DE | 9309748 U | * | 9/1993 |
| JP | 10295522 A | * | 11/1998 |
| JP | 11164766 A | * | 6/1999 |

* cited by examiner

*Primary Examiner*—Shaun R. Hurley
(74) *Attorney, Agent, or Firm*—William L. Muckelroy; Art Lessler; Gary Lipson

(57) ABSTRACT

An improved clothes hanger is biodegradable, disposable, and non-metallic. It is adapted to be usable in a prison, commercial airplane, or other weapons-free environment. The improved clothes hanger is provided by construction entirely of folded corrugated paper with two interconnected neck members. The neck members are intertwined via coordinated opposing slots in the hook portion of a clothes hanger having two shoulder portions. When a piece of clothing is hung on the clothes hanger, the folded doubled corrugated cardboard hanger supports and matches the curvature of the shoulders of the clothing, thus preventing wrinkling of the shoulders of the clothing. The structure is cut from a single piece of box corrugated cardboard and folded along a single fold line to form the hanger.

19 Claims, 3 Drawing Sheets

CORRUGATED CLOTHES HANGER STRUCTURE

BACKGROUND OF THE INVENTION

1. Field of the Invention

The present invention relates to an improved clothes hanger, more particularly to a clothes hanger that is purposefully frangible as a preventative measure against being restructured into a weapon that can cause bodily harm.

2. Description of the Prior Art

On Aug. 25, 1998 Schopfer was issued U.S. Pat. No. 5,021,934 for a garment carrier. The patent teaches that a blank for forming a garment carrier may be used once, or a few times, for transport of one or a few garments on hanger hooks, and then discarded. Like the novel invention presented, the carrier has a body of thin material, e.g. corrugated cardboard forming an orifice for receiving the free end of one or a few hangers.

On Feb. 8, 2000 Ho was granted U.S. Pat. No. 6,021,934 for an improved clothes hanger that includes metal wires and plastic bristles. The metal wires are intertwined and spiraled into the shape of a clothes hanger having two shoulder portions. The bristles are twined with the metal wires such that they are located at and project elastically from the shoulder portions of the clothes hanger. When a piece of clothing is hung on the clothes hanger, the bristles support and match the curvature of the shoulders of the clothing, thus preventing wrinkling of the shoulders of the clothing.

On Mar. 28, 2000 Balser was granted U.S. Pat. No. 6,041,985 for a multiple purpose coat hanger member having additional appendages extending laterally outwardly from the upper neck portion of the hanger from which hanger portions additional articles of clothing can be attached, such lateral extensions comprising a plurality of linear extending members affixed to the neck portion of the hanger, such lateral extension members having attachment means for hanging clothing articles on the extreme end thereof.

On Dec. 11, 2001 U.S. Pat. No. 6,328,186 was granted to Wing for a formable garment hanger wherein a foam tube is formed over a malleable wire. Since the malleable wire can be extracted and weaponized by being formed into a weapon, the novel invention is clearly distinguishable since it is made entirely of cardboard.

U.S. Pat. No. 6,481,603 was issued to Gish on Nov. 19, 2002 for a clothes hanger that has a hook for engaging a bar to support the change, a first and second side bar extending at substantially opposite angles from the hook, a horizontal bar extending between the side bars at ends of the side bars away from the hook, and a pliable compression strip having a particular length and opposite ends, one end engaging one of the side bars and the other end engaging the other of the side bars at engagement points on the side bars between the hook and the horizontal bar. The length of the pliable strip is greater than a straight line distance between the engagement points, such that the pliable strip, curving downward, urges against a portion of the horizontal bar, in a manner to secure an article of clothing against the horizontal bar.

On Jan. 21, 2003 U.S. Pat. No. 6,508,388 was granted to Louw for a hanger with a locking mechanism to secure gripping members that can be disengaged with a user operated lever. The gripping members engage and securely retain an item such as an article of clothing when the locking mechanism is engaged. A tab located on the gripping members acts as a lever and disengages the locking mechanism with decreased effort by an individual user. With this structure, the item can be easily secured to the hanger by engaging the locking mechanism, and freed by easily disengaging the locking mechanism by operation of the tab.

Clothes hangers have long been used in restricted facilities such as prisons, military installations, jails, and the like for storing clothing of guards, military personnel, and police on and off-duty. A major problem today is that the customary hard plastic hanger, wire hangers, wooden hangers, and combination metal and plastic hangers are a major raw material in prisons and restricted spaces often used to create weapons capable of stabbing or cutting and thereby causing serious bodily harm. There exists a long felt need in the prison industry for a clothes hanger that is not weaponizable and therefore weapon-proof.

SUMMARY OF THE INVENTION

The disadvantages of the prior art are overcome and the need for an unweaponizable hanger are met with the present invention wherein a utility design for a rigid clothes hanger made entirely of corrugated cardboard is presented which is inexpensive to produce, readily produced by stamping out a specific shape from available corrugated cardboard sheets and which further allows the hanger to be made in a variety of sizes such that it can be adapted to fit a wide variety of sizes and styles of clothing. A one piece hanger is made of corrugated cardboard cut out in a single piece from a corrugated cardboard sheet, folded and then intertwisted at dual mating neck parts that form a reinforced cardboard hook for the hanger.

OBJECTS OF THE INVENTION

It is accordingly a primary object of this invention to provide a clothes hanger suitable for use in prisons and related restricted spaces such as commercial airplanes.

It is another object of the present invention to provide a clothes hanger that cannot be weaponized.

It is still another object of the present invention to provide a clothes hanger made entirely of corrugated cardboard.

It is yet another object of the invention to provide a clothes hanger made of one continuous piece of corrugated cardboard folded and interconnected in a novel manner.

Yet another object of the novel invention is to provide a clothes hanger made of corrugated cardboard in a variety of sizes.

Still yet another object of the novel invention is to provide a disposable biodegradable corrugated cardboard clothes hanger with a reinforced hanging neck.

These and other objects and features of the present invention such as the ease of printing and displaying advertising thereon, for example, will be apparent from the following detailed description, taken with reference to the figures of the accompanying drawing.

BRIEF DESCRIPTION OF THE DRAWINGS

These and other features, aspects, and advantages of the present invention will become better understood with regard to the following description, appended claims, and accompanying drawings wherein:

DETAILED DESCRIPTION OF THE PREFERRED EMBODIMENTS

Figure 1:
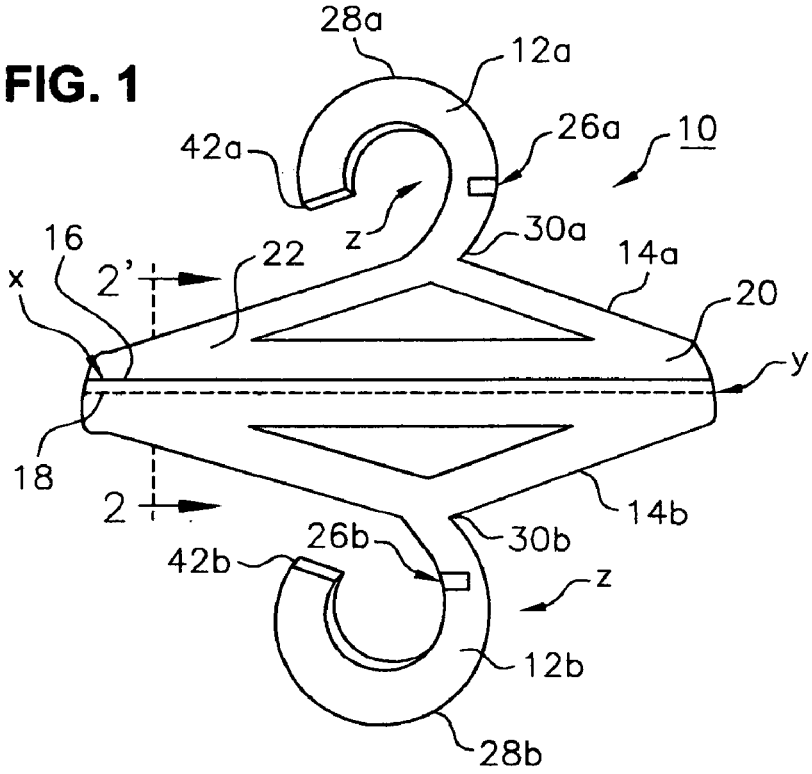
FIG. 1 is a detailed view showing a preferred one-piece embodiment of the invention unfolded and adapted with interlocking slots.

Referring to FIG. 1 there is shown a double clothes hanger shaped member 10 having a first slotted hook 12*a* and a second slotted hook 12*b*. Connected to the slotted hook 12*a* is a triangular shaped first shoulder body 14*a*. At the base of the body 14*a* there is a mirror image triangular shaped second shoulder body 14*b*. Near the base of the body 14*a* there is a first score 16 used as a fold line X. Near the base of the body 14*b* there is a second score 18 used as a fold line Y.

Figure 2:
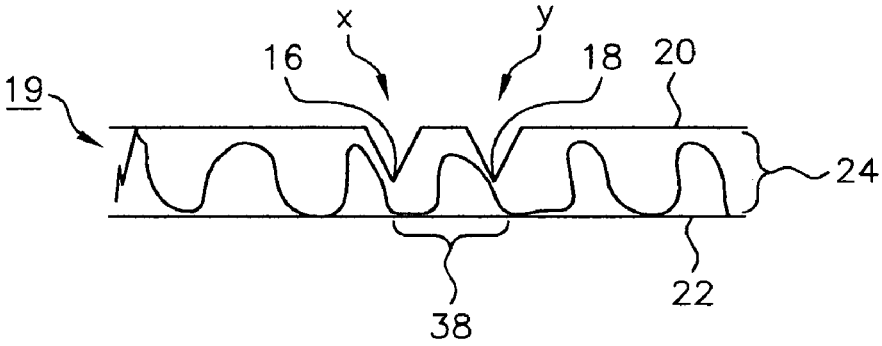
FIG. 2 is an end view of the embodiment shown in FIG. 1 showing cross-sections of scoring grooves X and Y.

Referring to FIG. 2 there is shown a cross sectional view taken along the plane 2-2' illustrated in FIG. 1. Shown is a section of a corrugated sheet member 19 preferably made of heavy-duty cardboard paper. The member 19 has a top sheet 20 and a bottom sheet 22 filled in between with corrugated filler 24. Further, there are shown cross-sections of the scores 16 and 18 used to form fold lines X and Y, respectively.

In FIG. 1 a novel cardboard paper clothes hanging instrument is formed from the slotted hanger 10 by folding the first shoulder body 14*a* along the line X toward the second shoulder body 14*b* and by folding the second shoulder body 14*b* along the line Y toward the first shoulder body 14*a*. Likewise, the first slotted hook 12*a* is utilized to form a hook piece for the novel hanging instrument by being folded toward the second slotted hook 12*b*. The slotted hooks 12*a* and 12*b* have a connection means, namely, a connector 25 (See FIG. 3) for example, located at a point Z, for interconnecting the slotted hook 12*a* to the slotted hook 12*b* which is self-acting and therefore interconnects without hardware or the addition of other structural elements. Thus, the hanging instrument shown is engineered to be stamped or die cut from a sheet of corrugated cardboard.

As shown in FIG. 1, the first slotted hook 12*a* has a first horizontal slot 26*a* which is U-shaped, opening toward the rear, and located at the rear of the hook 12*a* midway between a top 28*a* and a base 30*a* of the hook 12*a*. The second slotted hook 12*b* has a second horizontal slot 26*b*, which is also U-shaped. The first horizontal slot 26*a* opens in a mating relationship to the second horizontal slot 26*b*, which is located towards the front or opening of the slotted hook 12*b*. The horizontal slot 26*b* is located at the front of the hook 12*b* midway between an apex 28*b* and a base 30*b*. When the hook 12*b* is folded along the score 18 adjacent to the slotted hook 12*a*, the slots 26*a* and 26*b* are interlocked at a point Z. A hanger instrument 36 made entirely of corrugated paper or paperboard is therefore formed as shown in FIG. 3.

The hanger instrument 36 has fold lines X and Y with a base area 38 formed therein between these fold lines. The top sheet 20 of the corrugated cardboard is folded inside the instrument 36 up to the point Z of the neck 40. Above the point Z a hook 12 formed of double thickness corrugated cardboard is made from joined first and second slotted hooks 12*a* and 12*b*. The top 28*a* and apex 28*b* are automatically aligned to form a plural apex 28 for the instrument 36. Natural tension from the folded cardboard tends to spread the first and second slotted hooks 12*a* and 12*b*, which make up the hook 12 spread somewhat apart. This arrangement distributes the weight of a garment (not shown) on the instrument 36 equally between the slotted hooks 12*a* and 12*b* preventing undue stress and wear on slotted hook 12*a* at the expense of slotted hook 12*b* for repeated use of the instrument 36.

Figure 4A:
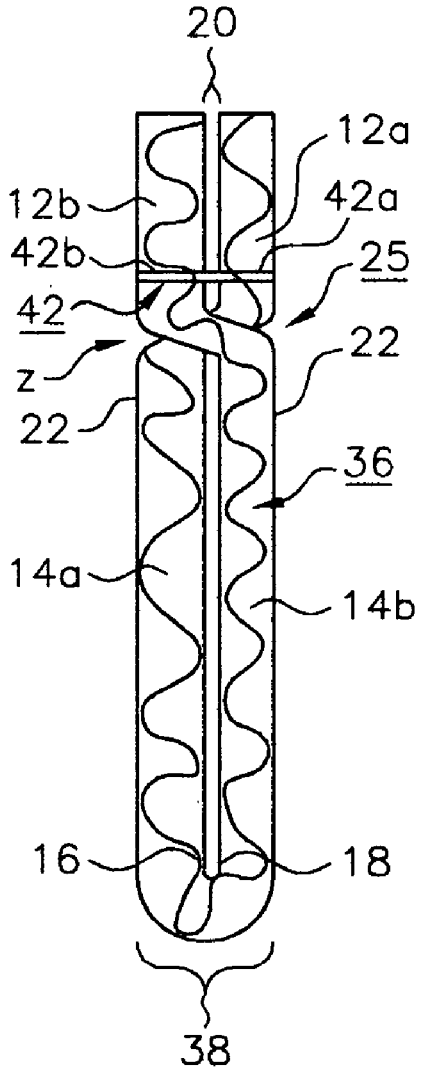
FIG. 4*a* is a detailed front view of the interlocked neck at Z.

In FIG. 4*a* there is shown a detailed front-end view of the instrument 36 from the base area 38 up to a margin 42 for hook 12 and above the connection point Z or connector 25. A part of the first slotted hook 12*a* is twisted and interconnected at the point Z opposite a like part of the second slotted hook 12*b*. The first shoulder body 14*a* is folded at the first score 16 flatly adjacent to the second shoulder body 14*b*. Likewise, the second shoulder body 14*b* is folded at the second score 18 flatly adjacent to the first shoulder body 14*a* to form the hanger instrument 36. The margin 42 is formed by the adjacent combination of a margin 42*a* for the first slotted hook 12*a*, for example, and the margin 42*b* for the second slotted hook 12*b*, for example.

Figure 3:
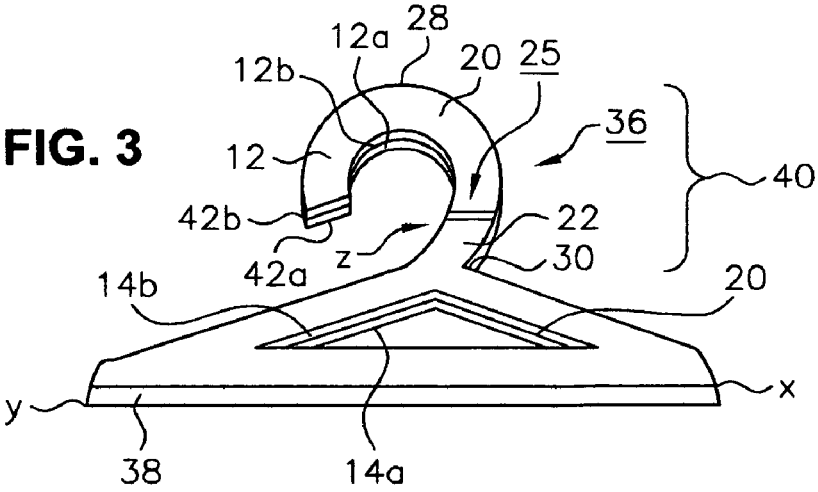
FIG. 3 is a detailed top view of the folded novel invention.
Figure 4B:
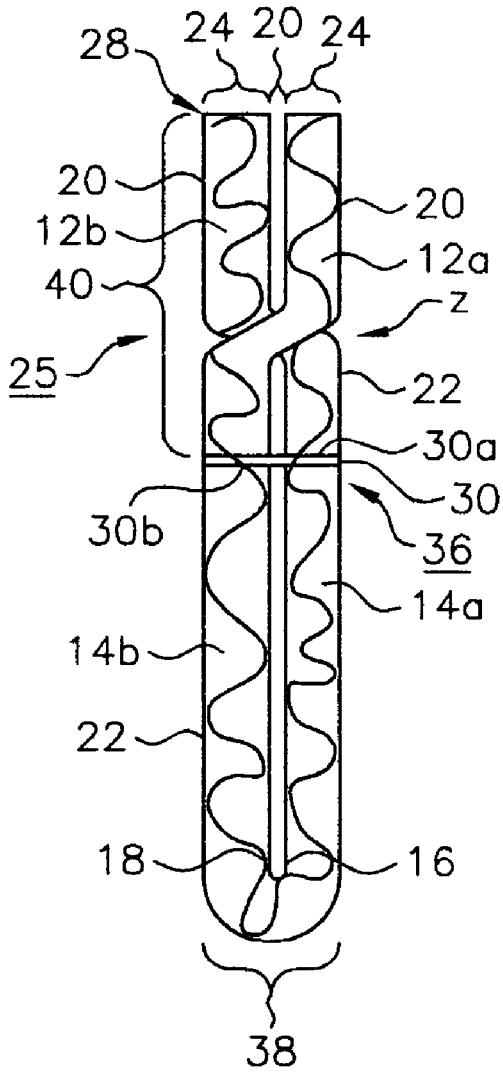
FIG. 4*b* is a detailed rear view of the interlocked neck at Z.

Referring now to FIG. 4*b*, there is shown a rear end view or edge view of the instrument 36 of FIG. 3 specifically illustrating the rear of the neck 40. The first base 30*a* is adjacent to the second base 30*b*. There is shown a detailed rear end view of the instrument 36. The neck 40 extends from a base 30, formed by the juxtaposition of the first base 30*a* and the second base 30*b*, up to the plural apex 28. The instrument 36 is shown extending from the base area 38 up to the plural apex 28 and then around and about the hook 12 to the margin 42 (shown in FIG. 4*a*). The first slotted hook 12*a* is twisted and connected to the second slotted hook 12*b* at the point Z opposite a like part of the second slotted hook 12*b*. The first shoulder body 14*a* is folded at the first score 16 flatly adjacent to the second shoulder body 14*b*. Likewise, the second shoulder body 14*b* is folded at the second score 18 flatly adjacent to the first shoulder body 14*a* to form the hanger instrument 36.

Figure 5:
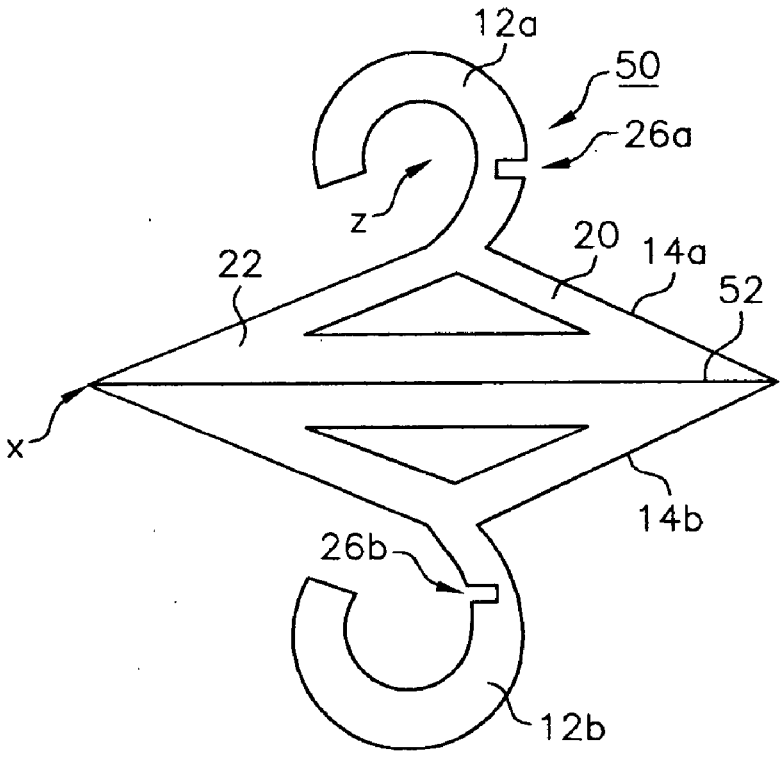
FIG. 5 is a detailed view of another embodiment using a single unscored fold line.

Shown in FIG. 5 is another less costly version of the invention. One of the scores, i.e. fold line Y is eliminated to make the novel invention a less expensive embodiment to produce. Garment hanger instrument 50 is made of corrugated paper and has one score line 52 therein for creating a fold X. Otherwise, the instrument 50 when folded and interconnected at the point Z is essentially the same as the unfolded slotted hanger 10 shown in FIG. 1 or the instrument 36 shown in FIG. 3.

Figure 6:
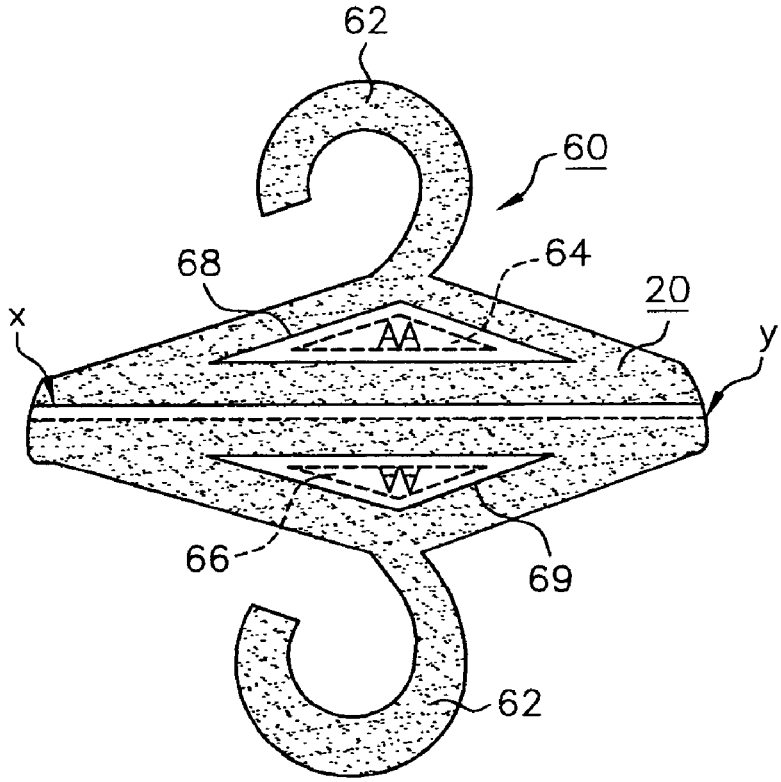
FIG. 6 is top view of an unfolded version of the invention with slots in the neck.

In FIG. 6 there is shown an unfolded garment hanger 60. The hanger 60 constitutes another slightly more costly version of the novel invention wherein the slots 26*a* and 26*b*, usually forming a part of the hook 12 as shown in FIG. 3, are eliminated by the addition of a coating 62, the coating being either hook or loop fasteners or an adhesive such as that used on Post-It's™, for example, on the surface of side 20 of the hanger 60. Triangular first and second windows 64 and 66 are cut out from the top and bottom of the hanger 60. Over these windows 64 and 66 transparent thin plastic window covers 68 and 69 are held in place by the coating 62.

An additional novel aspect of the invention is the addition of advertising such as the hypothetical logo "AA" shown there, for example. Such logos make this product more attractive to airlines, privately operated prisons, railroads, tour bus lines, and the like.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalent steps are, therefore, intended to be embraced by those claims.

PARTS LIST

10 slotted hanger
12 hook
12*a* first slotted hook
12*b* second slotted hook
14*a* first shoulder body
14*b* second shoulder body
16 first score
18 second score
19 corrugated sheet member
20 top sheet
22 bottom sheet
24 corrugated filler
25 connector
26*a* first horizontal slot
26*b* second horizontal slot
28*a* top
28*b* apex
28 plural apex
30 base
30*a* first base
30*b* second base
36 instrument
38 base area
40 neck
42 margin
42*a* margin
42*b* margin
50 garment hanger instrument
52 score line
60 garment hanger
62 adhesive coating
64 first window
66 second window
68 plastic window cover
69 plastic window cover

What is claimed is:

1. A frangible, disposable, biodegradable, non-metallic, non-plastic clothes hanger having a neck, comprising:

a pair of corrugated cardboard hooks each located above the neck;

an integral corrugated cardboard shoulder member;

the hooks being integrally connected to the integral corrugated cardboard shoulder member;

a single fold dividing the integral corrugated cardboard shoulder member;

the integral corrugated cardboard shoulder member being folded along said fold;

a first notch located in one of the corrugated cardboard hooks and a second notch opposing the first notch, the second notch being located in the other corrugated cardboard hook, both notches being located in the neck of the hanger, said pair of hooks being interlocked whereby a double layered corrugated cardboard hook is formed at the neck by the interlocked opposing notches.

2. The clothes hanger of claim 1 wherein the shoulder member is triangular and has left and right shoulders, whereby shoulder parts of a piece of clothing are hung on said clothes hanger member.

3. A disposable corrugated cardboard clothes hanger having first and a second hooks that are interlocked via slots at the neck for supporting the clothes hanger, the first hook reinforcing the second hook, the second hook reinforcing the first hook, the first hook having a first slot formed in the first hook, the second hook having a second slot formed in the second hook, the first slot being interlocked with the second slot, said clothes hanger further having a shoulder means for grossly emulating structural shoulder support for shirts, coats, and like clothing hung on said hanger, the clothes hanger comprised entirely of corrugated cardboard folded along a dividing fold whereby the interlock of the first and second slots hold one side of the clothes hanger to the other at a site where the first slot interlocks with the second slot.

4. The clothes hanger of claim 3 further comprising a single dividing fold, the corrugated cardboard being one continuous folded piece folded once linearly along the single dividing fold.

5. The clothes hanger of claim 3 wherein the one continuous folded piece of corrugated cardboard has a top surface and a bottom surface, the piece having first and second parallel creases on the top surface thereof, the piece being folded at a right angle once and only once along the first crease wherein a first member is formed, the piece being folded at an opposing right angle once and only once along the second crease wherein a second member is formed.

6. The disposable clothes hanger of claim 4 wherein the reinforced hooks support the clothes hanger and wherein the hanger is made of frangible corrugated cardboard whereby the disposable hanger is resistant to being formed into a rigid weapon.

7. The disposable clothes hanger of claim 6 wherein the first hook and the second hook interlocked by slots are further reinforced using an adhesive coating formed on one side of the piece of corrugated cardboard.

8. The disposable clothes hanger of claim 7 being further reinforced by an adhesive located in between the first member and the second member and further located in between the first hook and the second hook and wherein each of the slots each have a similar rectangular perimeter.

9. The disposable clothes hanger of claim 8 wherein between the first member and the second member there is a window wherein advertising is displayed, the window being bound to the disposable clothes hanger by the adhesive coating of the corrugated cardboard.

10. The disposable clothes hanger of claim 9 wherein the window comprises a sheet of transparent plastic showing advertising.

11. The disposable clothes hanger of claim 4 wherein the folds are scored.

12. The frangible, disposable, biodegradable, non-metallic, non-plastic clothes hanger of claim 11 wherein the pair of interconnected corrugated cardboard hooks have a connecting means for interconnecting the hooks to each other.

13. The clothes hanger of claim 12 wherein the connecting means for interconnecting the hooks to each other comprises interlocking mated slots formed in the hooks.

14. The clothes hanger of claim 12 wherein the connecting means for interconnecting comprises an area of hook fasteners on a mating surface of one hook and an area of loop fasteners on another mating surface of the other hook, the hook and loop fasteners being joined together.

15. A method for making a frangible disposable clothes hanger from a flat single sheet of corrugated cardboard, the hanger being of a type having a hook connected to a neck with the neck connected to a triangular body having a straight lower horizontal bar with a top edge and a bottom edge, the top edge of the lower horizontal bar being for supporting slacks and the like comprising the steps of:

(a) Providing a flat expanse of corrugated cardboard having an area matching at least two clothes hanger perimeters wherein the two clothes hanger perimeters are co-joined at the bottom edge and wherein the hooks of the two clothes hanger perimeters are mirror images of each other;

(b) Cutting out said area from the flat expanse of corrugated cardboard;

(c) Cutting out a mating triangular area having a base length selected to hang trousers thereon from each triangular body, the mating triangular area having a perimeter substantially smaller than that of the triangular body;

(d) Cutting out a mating hook and neck from the flat expanse of corrugated cardboard for each of the two clothes hanger perimeters;

(e) Cutting out a joining means for joining the mating hooks and the mating necks;

(f) Folding the two clothes hanger perimeters at the co-joined bottom edge; and (g) Joining the mating hooks, whereby an integral all-paper corrugated cardboard clothes hanger is formed, wherein the step of cutting out a joining means further comprises forming interlocking slots in the mating hooks.

16. The method of claim 15 wherein the step of joining the mating hooks comprises gluing said mating hooks together.

17. The method of claim 15 further comprising the step of joining the mating necks.

18. The method of claim 15 wherein each of the two clothes hanger perimeters encompasses a mating surface and wherein the method further comprises covering one mating surface with hook fasteners and covering the other mating surface with loop fasteners.

19. The method of claim 18 further comprising the step of connecting the hook and loop fasteners whereby one clothes hanger with a first perimeter congruently faces and connects to the other clothes hanger with a matching second perimeter.

* * * * *